US010704445B2

(12) United States Patent
Sato et al.

(10) Patent No.: US 10,704,445 B2
(45) Date of Patent: Jul. 7, 2020

(54) CATALYTIC CONVERTER

(71) Applicant: AISIN TAKAOKA CO., LTD., Toyota-shi, Aichi (JP)

(72) Inventors: Akira Sato, Toyota (JP); Satoru Isaji, Toyota (JP)

(73) Assignee: AISIN TAKAOKA CO., LTD., Toyota-Shi, Aichi (JP)

( * ) Notice: Subject to any disclaimer, the term of this patent is extended or adjusted under 35 U.S.C. 154(b) by 0 days.

(21) Appl. No.: 16/180,135

(22) Filed: Nov. 5, 2018

(65) Prior Publication Data

US 2019/0136736 A1 May 9, 2019

(30) Foreign Application Priority Data

Nov. 9, 2017 (JP) ..... 2017-216215

(51) Int. Cl.
*F01N 3/00* (2006.01)
*F01N 3/28* (2006.01)
(Continued)

(52) U.S. Cl.
CPC ..... *F01N 3/2892* (2013.01); *F01N 3/10* (2013.01); *F01N 3/2839* (2013.01);
(Continued)

(58) Field of Classification Search
CPC ..... F01N 3/2892; F01N 3/2839; F01N 3/10; F01N 2340/06; F02B 37/18
(Continued)

(56) References Cited

U.S. PATENT DOCUMENTS

2012/0036847 A1* 2/2012 Schreiber ..... F02B 37/18 60/602
2012/0291431 A1 11/2012 Bucknell et al.
(Continued)

FOREIGN PATENT DOCUMENTS

EP 1612385 A1 1/2006
FR 3032230 A1 8/2016
(Continued)

OTHER PUBLICATIONS

Extended European Search Report dated Jan. 30, 2019 issued by the European Patent Office in corresponding European Patent Application No. 182049668.8 (5 pages).

*Primary Examiner* — Jason D Shanske
(74) *Attorney, Agent, or Firm* — Buchanan Ingersoll & Rooney PC

(57) ABSTRACT

An exhaust gas receiver 21 is provided between an expanded passage portion 132 of an upstream connection member 13 and a catalyst end surface 111. The exhaust gas receiver 21 extends along the entire circumference of a catalyst accommodation case 12. The exhaust gas receiver 21 extends from an upstream opening end portion 121 of the catalyst accommodation case 12 toward an inner part of the passage of the expanded passage portion 132 such that the exhaust gas receiver 21 separates from the expanded passage portion 132, and a space 211 is defined between the exhaust gas receiver 21 and the catalyst end surface 111. Flows of bypass exhaust gas hitting against the catalyst end surface 111 and bouncing off the catalyst end surface 111 hit against and are received by the exhaust gas receiver 21.

7 Claims, 9 Drawing Sheets

(51) Int. Cl.

| | |
|---|---|
| ***F01N 3/10*** | (2006.01) |
| *F02B 37/18* | (2006.01) |
| *F01N 13/18* | (2010.01) |
| *F02B 37/00* | (2006.01) |
| *F01N 3/20* | (2006.01) |

(52) U.S. Cl.
CPC ..... *F01N 3/2006* (2013.01); *F01N 13/1838* (2013.01); *F01N 2260/08* (2013.01); *F01N 2260/14* (2013.01); *F01N 2340/06* (2013.01); *F01N 2410/06* (2013.01); *F02B 37/00* (2013.01); *F02B 37/18* (2013.01)

(58) Field of Classification Search
USPC ..... 60/274
See application file for complete search history.

(56) References Cited

U.S. PATENT DOCUMENTS

| | | | | |
|---|---|---|---|---|
| 2015/0040561 | A1* | 2/2015 | Matsui | F01N 3/2006 60/602 |
| 2017/0152793 | A1* | 6/2017 | Albrecht | F01N 3/2006 |
| 2018/0258817 | A1* | 9/2018 | Kosuge | F02D 41/064 |
| 2018/0334978 | A1* | 11/2018 | Kitaura | F02D 41/0235 |

FOREIGN PATENT DOCUMENTS

| | | | |
|---|---|---|---|
| JP | 2010180781 | A | 8/2010 |
| JP | 2017082762 | A | 5/2017 |
| WO | 2010/123787 | A2 | 10/2010 |
| WO | 2016/005370 | A1 | 1/2016 |

* cited by examiner

CATALYTIC CONVERTER

CROSS-REFERENCE TO RELATED APPLICATIONS

The present application is based on Japanese Patent Application. No. 2017-216215 filed on. Nov. 9, 2017, and the entire content described therein is incorporated in the present specification.

BACKGROUND OF THE INVENTION

Field of the Invention

The present disclosure relates to a catalytic converter.

Description of the Related Art

An internal combustion engine of a vehicle or the like has a catalytic converter in an exhaust system thereof. The catalytic converter includes a cylindrical catalyst, a catalyst accommodation case, and an upstream connection member for leading an exhaust gas to the catalyst and cleans exhaust gas through passage of the exhaust gas through the catalyst along the axial direction of the catalyst. In the case where a turbocharger is provided in the exhaust system, the catalytic converter is provided downstream of the turbocharger.

The turbocharger is in a cold state during first idle immediately after engine starting. When exhaust gas passes through the cold turbocharger, a turbine impeller, an internal passage, etc., draw a heat from the exhaust gas. In this case, the exhaust gas supplied to the catalytic converter may possibly have a temperature insufficient for activating the catalyst.

In view of this, there is proposed a turbocharger configured such that a bypass passage is provided in a turbine housing of the turbocharger so as to cause the exhaust gas to bypass a turbine. At a stage immediately after engine starting, a bypass exhaust gas flows through the bypass passage, so that the bypass exhaust gas whose temperature drop is restrained is supplied to the catalytic converter. Accordingly, time required for the catalyst to reach an activation temperature is shortened, whereby capability in cleaning the exhaust gas can be improved. In this case, if the bypass exhaust gas perpendicularly hits against the end surface of the catalyst, the bypass exhaust gas easily flows to the downstream side of the catalyst, since an exhaust gas passages of the catalyst are formed along the axial direction of the catalyst. As a result, the heat may become less likely to be transmitted to the catalyst. In order to avoid this, exhaust gas is caused to obliquely hit against the end surface of the catalyst as disclosed in, for example, Japanese Patent. Application Laid-Open (kokai) No. 2017-82762.

In the case where the bypass exhaust gas is caused to obliquely hit against the end surface of the catalyst, the bypass exhaust gas hitting against the end surface of the catalyst bounces off the end surface, thereby forming a bounce gas flows. Since the bounced bypass exhaust gas hits against the inner surface of an upstream connection member of the catalytic converter, the heat of the bypass exhaust gas is released outward through the upstream connection member in contact with the outside air. As a result of the release of the heat from the exhaust gas, the heat is drawn from the bypass exhaust gas, so that the heat of the bypass exhaust gas cannot be efficiently transmitted to the catalyst.

SUMMARY OF THE INVENTION

The present disclosure has been accomplished in view of the foregoing, and its main object is to provide a catalytic converter in which can efficiently transmit the heat of the bypass exhaust gas to the catalyst.

A catalytic converter of the present disclosure comprises a catalyst accommodation case configured to accommodate a catalyst; and an upstream connection member having an upstream passage portion of which a passage area is smaller than an area of an end surface of the catalyst and which leads an exhaust gas flowing out from a turbocharger to the catalyst, and an expanded passage portion located downstream of the upstream passage portion and connected to an upstream opening end portion of the catalyst accommodation case to expand from the upstream passage portion; wherein the turbocharger includes a bypass passage out from which a bypass exhaust gas flows; and the catalyst end surface is provided at a position that a bypass exhaust gas flowing out from the outlet of the bypass passage flows along a flow path inclined toward one side with respect to a line perpendicular to the catalyst end surface and hits against the catalyst end surface; and the catalytic converter further comprises an exhaust gas receiver provided between the expanded passage portion and the catalyst end surface at least in a counter-inclination-side portion opposite the side toward which the flow path is inclined, and configured to receive a flow of the bypass exhaust gas bouncing off the catalyst end surface, and the exhaust gas receiver extends from the upstream opening end portion of the catalyst accommodation case toward an inner part of the expanded passage portion, being separated from the expanded passage portion and a space is defined between the exhaust gas receiver and the catalyst end surface.

Exhaust gas flowing out from the bypass passage of the turbocharger obliquely hits against the catalyst end surface of the catalytic converter. In this case, a portion of the bypass exhaust gas hitting against the catalyst end surface bounces off the catalyst end surface. In the catalytic converter of the present disclosure, a flow of the bounced bypass exhaust gas is received by the exhaust gas receiver, whereby the bypass exhaust gas flow is restrained from hitting against the expanded passage portion of the upstream connection member. Thus, there is restrained outward release of the heat of the bypass exhaust gas through the expanded passage portion of the upstream connection member in contact with the outside air, so that the heat of the bypass exhaust gas can be efficiently transmitted to the catalyst.

In the catalytic converter of the present disclosure, preferably, an inner edge portion of the exhaust gas receiver is directed toward the catalyst end surface.

In the above-mentioned catalytic converter, a bounce flow of the bypass exhaust gas hitting against the exhaust gas receiver is led toward the catalyst end surface by the exhaust gas receiver. Accordingly, the bounce flow of the bypass exhaust gas hitting against the exhaust gas receiver can be smoothly merged into the mainstream of the exhaust gas.

In the catalytic converter of the present disclosure, preferably, the exhaust gas receiver is provided along the upstream opening end portion of the catalyst accommodation case to extend in a circumferential direction, and an inner edge portion of the exhaust gas receiver reduces in height above the catalyst end surface circumferentially from the counter-inclination-side portion toward the side toward which the flow path is inclined.

The bounce flow of the bypass exhaust gas becomes a relatively large flow in the counter-inclination-side portion and becomes a smaller flow toward the side toward which the flow path is inclined. In the case of need to receive a larger flow, the height of the exhaust gas receiver must be increased so as to increase the size of the space. In this connection, in the above-mentioned catalytic converter, since the exhaust gas receiver is designed to have the largest height in the counter-inclination-side portion, the exhaust gas receiver can more reliably receive the bounce flow. Also, since the exhaust gas receiver is designed to reduce in height toward the side toward which the flow path is inclined, despite provision of the exhaust gas receiver between the expanded passage portion of the upstream connection member and the catalyst end surface, design freedom of the expanded passage portion is less likely to be affected by presence of the exhaust gas receiver.

In the catalytic converter of the present disclosure, preferably, a width of the exhaust gas receiver in a plan view as viewed in a direction perpendicular to the catalyst end surface gradually reduces along a circumference of the upstream opening end portion of the catalyst accommodation case.

In the above-mentioned catalytic converter, since the exhaust gas receiver is designed to have the largest width in the counter-inclination-side portion, the exhaust gas receiver can more reliably receive the bounce flow. Also, since the exhaust gas receiver is designed to reduce in height toward the side toward which the flow path is inclined, despite provision of the exhaust gas receiver between the expanded passage portion of the upstream connection member and the catalyst end surface, design freedom of the expanded passage portion is less likely to be affected by presence of the exhaust gas receiver.

In the catalytic converter of the present disclosure, preferably, the exhaust gas receiver extends along the entire circumference of the catalyst accommodation case.

In the above-mentioned catalytic converter, since the exhaust gas receiver receives the bounce flow of the bypass exhaust gas along the entire circumference, the bounce flow is further restrained from hitting against the expanded passage portion of the upstream connection member, so that the heat of the bypass exhaust gas can be more efficiently transmitted to the catalyst.

In the catalytic converter of the present disclosure, preferably, an opening defined by an inner edge portion of the exhaust gas receiver has a size for allowing passage of a mainstream of the bypass exhaust gas flowing out from the passage outlet of the bypass passage and hitting against the catalyst end surface.

In the above-mentioned catalytic converter, despite provision of the exhaust gas receiver along the entire circumference, the mainstream of the bypass exhaust gas directed to the catalyst end surface is less likely to be disturbed by presence of the exhaust gas receiver.

In the catalytic converter of the present disclosure, preferably, the exhaust gas receiver has a slit which establishes communication between a space on the upstream side of the exhaust gas receiver and a space on the downstream side of the exhaust gas receiver; and the slit has an upstream-side slit portion provided on the upstream side of the exhaust gas receiver, a downstream-side slit portion provided on the downstream side of the exhaust gas receiver at a position offset from the upstream-side slit portion, and a slit passage portion establishing communication between the upstream-side slit portion and the downstream-side slit portion and allowing the bypass exhaust gas flowing in from the upstream-side slit portion to flow toward the downstream-side slit portion.

In the above-mentioned catalytic converter, the bypass exhaust gas flowing to the exhaust gas receiver from the upstream side passes the exhaust gas receiver through the slit and flows to the downstream side of the exhaust gas receiver. Therefore, a flow of the bypass exhaust gas is less likely to be disturbed by presence of the exhaust gas receiver. Also, since the upstream-side slit portion and the downstream-side slit portion are offset in position from each other, despite provision of the slit, the exhaust gas receiver can receive the bounce flow of the bypass exhaust gas.

The object described above and other objects, features, and advantages of the present disclosure will be apparent from the following detailed description with reference to the accompanying drawings.

DETAILED DESCRIPTION OF THE PREFERRED EMBODIMENT

An embodiment of the present disclosure will now be described with reference to the drawings. The present disclosure is embodied in the form of an automotive catalytic converter to be attached to an upstream turbocharger having a bypass passage.

Figure 1:
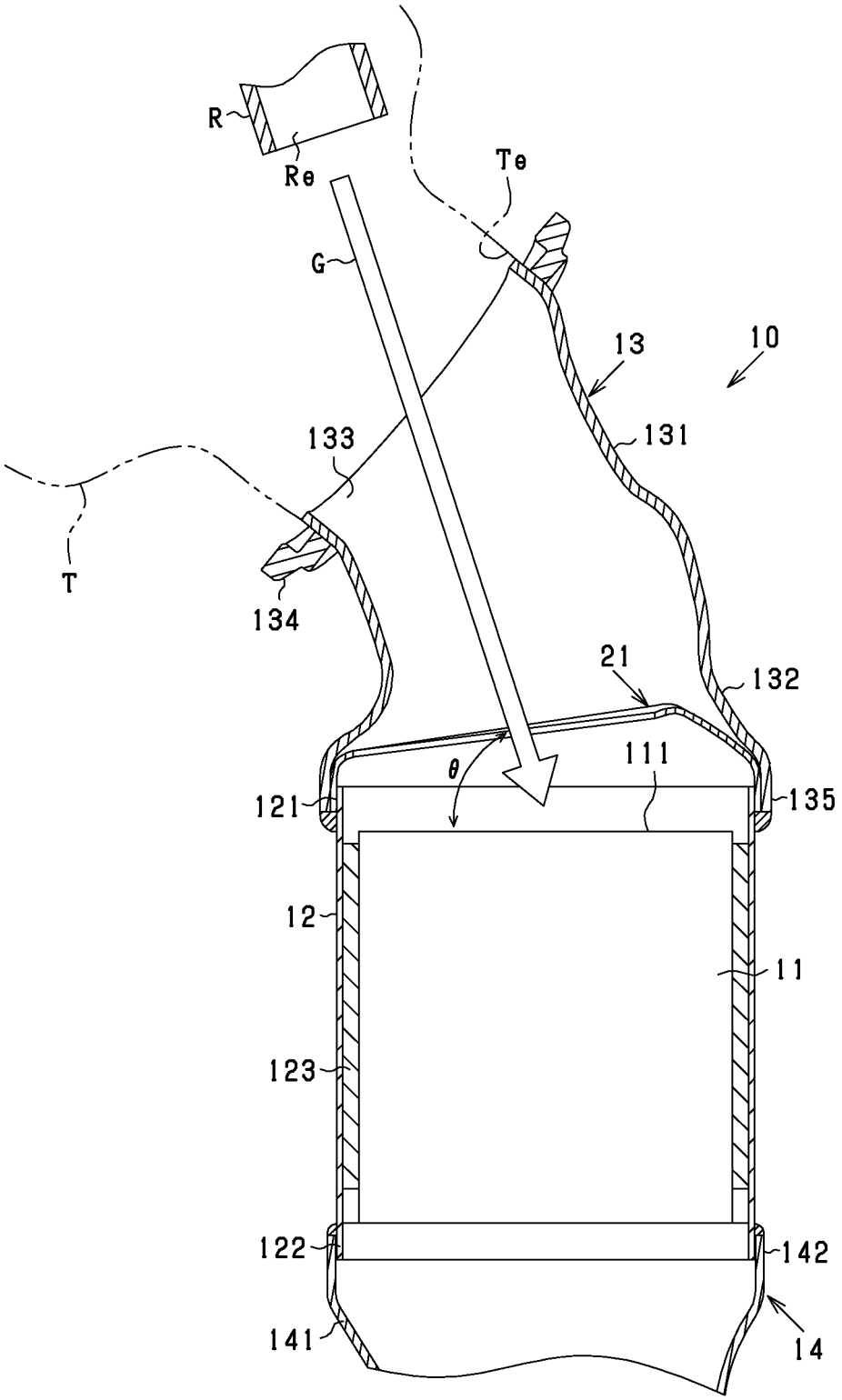
FIG. 1 is a sectional view showing a catalytic converter.

First, the basic structure of a catalytic converter 10 will be described with reference to FIGS. 1 and 2. As shown in FIG. 1, the catalytic converter 10 has a catalyst 11, a catalyst accommodation case 12, an upstream connection member 13, and a downstream connection member 14.

The catalyst 11 is configured such that catalyst compositions such as platinum and palladium are carried in a cylindrical catalyst carrier made of ceramic or a metal. The catalyst carrier has a honeycomb structure in which a large number of exhaust gas passages are disposed in a honeycomb pattern. The exhaust gas flows through the exhaust gas passages in the axial direction of the catalyst carrier.

The catalyst accommodation case 12 accommodates the catalyst 11 therein. The catalyst accommodation case 12 is manufactured by forming a metal plate having a high heat resistance such as a stainless steel plate into a seamless cylindrical shape. The catalyst accommodation case 12 has an upstream opening end portion 121 and a downstream opening end portion 122 at its axially opposite end portions, respectively. The catalyst accommodation case 12 has a seal member 123 provided therein between the catalyst 11 and the inner surface of the catalyst accommodation case 12. The seal member 123 retains the catalyst 11 along its entire circumference within the catalyst accommodation case 12. The seal member 123 is formed from a heat resistant fiber such as alumina fiber into a cylindrical shape.

The upstream connection member 13 is provided upstream of the catalyst accommodation case 12. The upstream connection member 13 is manufactured by forming a metal plate having the high heat resistance such as a stainless steel plate into a seamless cylindrical shape. The upstream connection member 13 has an upstream passage portion 131 and an expanded passage portion 132.

The upstream passage portion 131 has a passage into which the exhaust gas flowing out from a turbocharger T flows and which leads the exhaust gas to the catalyst 11. The upstream passage portion 131 has a circular passage section smaller than the cross section of the catalyst 11. The upstream passage portion 131 has an exhaust inlet 133 provided at its upstream end portion. In order to efficiently dispose the catalytic converter 10 together with an engine, the turbocharger T, etc., within an engine room, the exhaust inlet 133 is inclined in relation to a catalyst end surface 111 of the catalyst 11. An inlet flange 134 is provided at the exhaust inlet 133 for connection to an exhaust outlet Te of the turbocharger T.

The expanded passage portion 132 is located downstream of the upstream passage portion 131 and has a passage through which the exhaust gas having flowed through the upstream passage portion 131 flows before reaching the catalyst 11. The expanded passage portion 132 is expanded in passage section from the upstream passage portion 131 toward the downstream side. A downstream connection end portion 135 of the expanded passage portion 132 is formed into a circular shape and has an inner diameter greater than the outer diameter of the upstream opening end portion 121 of the catalyst accommodation case 12. As shown also in FIG. 2, the downstream connection end portion 135 is externally fitted to the upstream opening end portion 121 of the catalyst accommodation case 12 such that the downstream connection end portion 135 comes into contact with the outer circumferential surface of the upstream opening end portion 121. The upstream connection member 13 is welded to the upstream opening end portion 121 of the catalyst accommodation case 12 at the downstream connection end portion 135 of the expanded passage portion 132, whereby the upstream connection member 13 and the catalyst accommodation case 12 are joined to each other and are integrated with each other.

The upstream passage portion 131 and the expanded passage portion 132 of the upstream connection member 13 are formed such that the catalyst end surface 111 of the catalyst 11 is disposed on an extension of a passage outlet Re of a bypass passage R of the turbocharger T. Additionally, the upstream passage portion 131 and the expanded passage portion 132 are formed such that a bypass exhaust gas (indicated by the arrow in FIG. 1) flowing out from the passage outlet Re of the bypass passage R obliquely hits against the catalyst end surface 111 at an acute hitting angle θ with respect to the catalyst end surface 111.

The downstream connection member 14 is provided downstream of the catalyst accommodation case 12, The downstream connection member 14 is manufactured by forming a metal plate having the high heat resistance such as a stainless steel plate into a seamless cylindrical shape. The downstream connection member 14 has a downstream passage portion 141.

The downstream passage portion 141 leads further downstream the exhaust gas having flowed through the catalyst 11 and flowing thereinto. An upstream connection end portion 142 of the downstream passage portion 141 has a circular shape and has a diameter greater than that of the downstream opening end portion 122 of the catalyst accommodation case 12. The upstream connection end portion 142 is externally fitted to the downstream opening end portion 122 of the catalyst accommodation case 12 such that the upstream connection end portion 142 comes into contact with the outer circumferential surface of the downstream opening end portion 122. The downstream connection member 14 is welded to the downstream opening end portion 122 of the catalyst accommodation case 12 at the upstream connection end portion 142, whereby the downstream connection member 14 and the catalyst accommodation case 12 are joined to each other and are integrated with each other.

In the catalyst converter 10 having the above-described configuration, the exhaust gas flowing into the catalyst converter 10 from the exhaust inlet 133 flows through the upstream passage portion 131 and the expanded passage portion 132 and then flows into the exhaust gas passages of the catalyst 11 from the catalyst end surface 111. The exhaust gas cleaned through passage through the exhaust gas passages of the catalyst 11 flows downstream from the catalyst 11, passes through the downstream passage portion 141, and then flows downstream from the catalyst converter 10.

At a stage immediately after engine starting, the bypass exhaust gas flowing out from the passage outlet Re of the bypass passage R of the turbocharger T flows into the catalyst converter 10. In this case, since the catalyst end surface 111 is provided on an imaginary line extending from the passage outlet Re, as indicated by the arrow, the bypass exhaust gas flows along a straight flow path and obliquely hits against the catalyst end surface 111 at an acute hitting angle θ with respect to the catalyst end surface 111.

In addition to the above basic structure, the catalytic converter 10 of the present embodiment has an exhaust gas receiver 21 for receiving, immediately after engine starting, the bypass exhaust gas flows which are produced as a result of the bypass exhaust gas obliquely hitting against the catalyst end surface 111 at an acute hitting angle θ and bouncing off the catalyst end surface 111. The exhaust gas receiver 21 will be described in detail with reference to FIGS. 2 and 3. The section of the exhaust gas receiver 21 in FIG. 2 is taken along line II-II of FIG. 3.

The exhaust gas receiver 21 is manufactured by forming a metal plate having the high heat resistance such as a stainless steel plate into a shape to be described later. As shown in FIG. 2, the exhaust gas receiver 21 is provided between the expanded passage portion 132 of the upstream connection member 13 and the catalyst end surface 111.

The exhaust gas receiver 21 has an attachment tube portion 22 for attaching the exhaust gas receiver 21 to the catalyst accommodation case 12. The attachment tube portion 22 has a cylindrical shape and has an inner diameter greater than the outer diameter of the upstream opening end portion 121 of the catalyst accommodation case 12 and has an outer diameter smaller than the inner diameter of the downstream connection end portion 135 of the expanded passage portion 132 of the upstream connection member 13. The attachment tube portion 22 is provided between and in contact with the upstream opening end portion 121 of the catalyst accommodation case 12 and the downstream connection end portion 135 of the expanded passage portion 132. In the case where the upstream connection member 13 is welded to the catalyst accommodation case 12 at the downstream connection end portion 135 of the expanded passage portion 132, the attachment tube portion 22 is also welded. As a result of this welding, the upstream connection member 13, the attachment tube portion 22, and the catalyst accommodation case 12 are joined together, so that the exhaust gas receiver 21 is attached in place.

The exhaust gas receiver 21 extends from the entire circumference of an upstream end portion of the attachment tube portion 22 toward an inner part of the passage of the expanded passage portion 132. The exhaust gas receiver 21 extends toward an inner part of the passage of the expanded passage portion 132 in such a manner as to extend obliquely upstream, so that the exhaust gas receiver 21 separates from the expanded passage portion 132 and a space 211 is defined between the exhaust gas receiver 21 and the catalyst end surface 111. Thus, the exhaust gas receiver 21 extends along the entire circumference of the catalyst accommodation case 12, and the space 211 defined between the exhaust gas receiver 21 and the catalyst end surface 111 also extends along the entire circumference. As shown in FIGS. 2 and 3, the exhaust gas receiver 21 extending toward an inner part of the passage has an inner edge portion 212 at its distal end, and the approximate entirety of the inner edge portion 212 is directed toward the catalyst end surface 111.

As shown in FIG. 3, in a plan view as viewed in a direction perpendicular to the catalyst end surface 111, the inner edge portion 212 at the distal end of the exhaust gas receiver 21 defines a circular opening 213. The position and size of the opening 213 are determined so as to allow the passage of the mainstream Ga of the bypass exhaust gas flowing out from the passage outlet Re of the bypass passage R of the turbocharger T and hitting against the catalyst end surface 111. For example, preferably, the size of the opening 213 is greater than the smallest passage section of the upstream passage portion 131 of the upstream connection member 13.

In the above-mentioned plan view, a width L of the exhaust gas receiver 21 between an outer edge portion 214 and the inner edge portion 212 along a radial direction is the largest in a portion (hereinafter, referred to as a counter-inclination-side portion 216) opposite a portion (hereinafter, referred to as an inclination-side portion 215) toward which the flow path along which the bypass exhaust gas flows and hits against the catalyst end surface 111 is inclined. That is, the width L gradually reduces from the counter-inclination-side portion 216 along a circumferential direction. Thus, the opening 213 is offset from the center of a circle defined by the outer edge portion 214 of the exhaust gas receiver 21 toward the inclination-side portion 215 toward which the flow path of the bypass exhaust gas is inclined.

Figure 2:
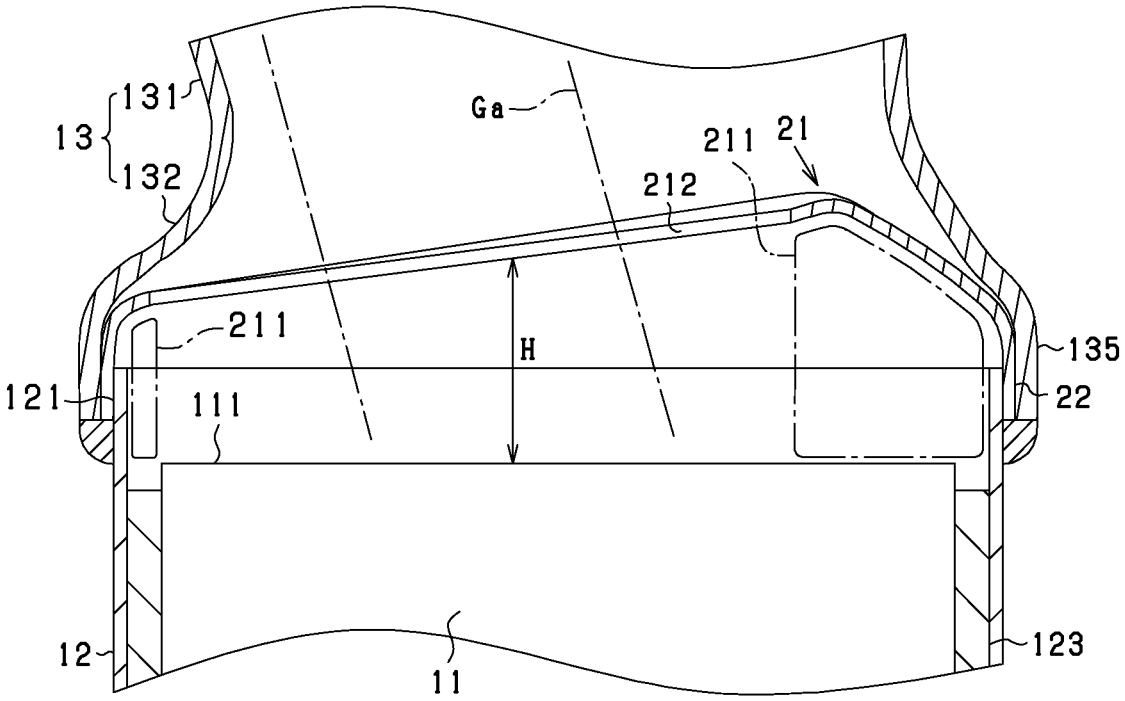
FIG. 2 is an enlarged sectional view showing an exhaust gas receiver.
Figure 3:
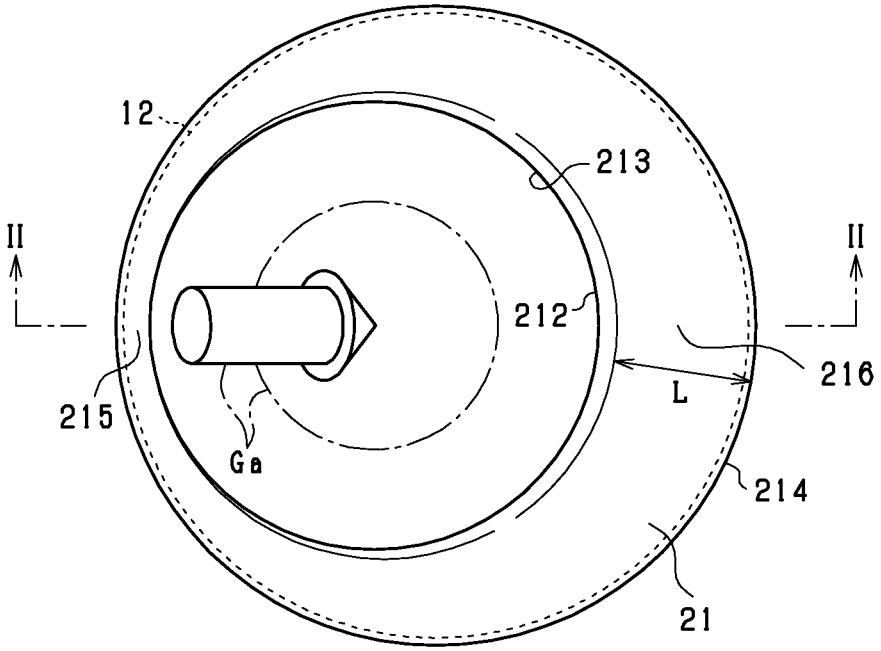
FIG. 3 is a plan view of the exhaust gas receiver.

As shown in FIG. 2, the exhaust gas receiver 21 is configured such that its inner edge portion 212 reduces in height H above the catalyst end surface 111, along the circumferential direction, from the counter-inclination-side portion 216 toward the inclination-side portion 215. Thus, the inner edge portion 212 of the exhaust gas receiver 21 is such that the height H above the catalyst end surface 111 is the largest in the counter-inclination-side portion 216, reduces toward the inclination-side portion 215 along the circumferential direction, and is the smallest at the inclination-side portion 215.

The width L and the height H of the exhaust gas receiver 21 are determined as mentioned above for the following reason: a bounce flow which is produced as a result of the bypass exhaust gas hitting against the catalyst end surface 111 becomes a relatively large flow in the counter-inclination-side portion 216 and becomes a smaller flow toward the inclination-side portion 215. In the case of need to receive a larger flow, the width L of the exhaust gas receiver 21 and the height H of the inner edge portion 212 must be increased so as to increase the size of the space 211. Thus, as a result of determination of the width L and the height H as mentioned above, the space 211 defined by the exhaust gas receiver 21 is the largest in the counter-inclination-side portion 216 and gradually reduces in size from the counter-inclination-side portion 216 along the circumferential direction.

Figure 4:
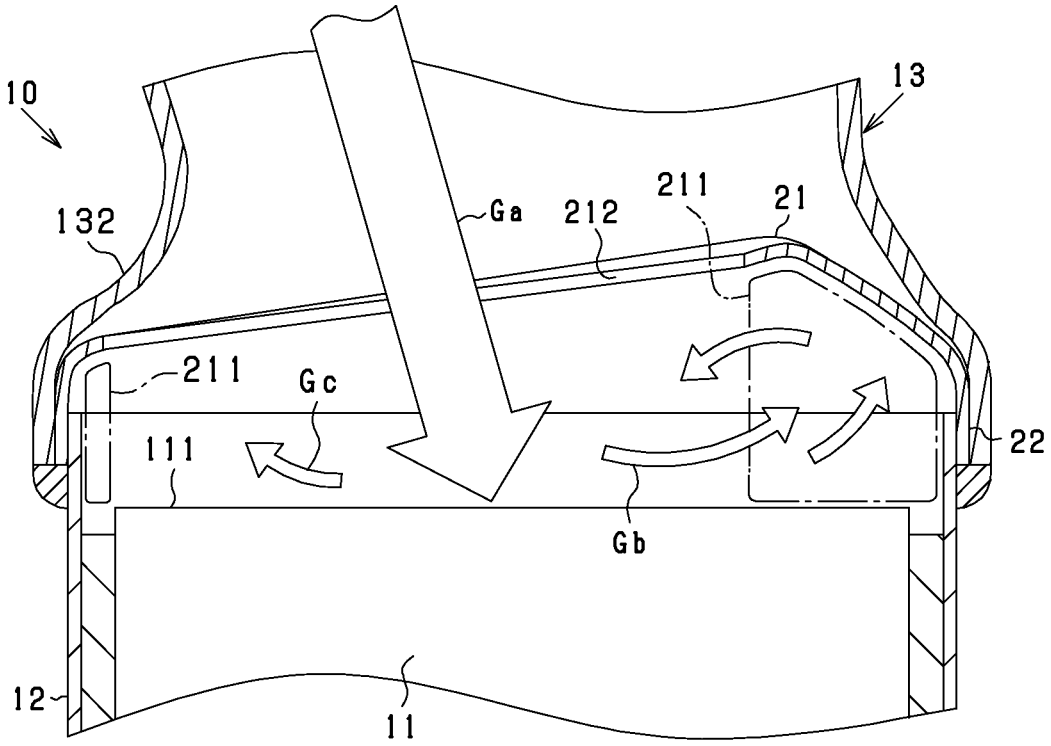
FIG. 4 is an enlarged sectional view for explaining flows of the bypass exhaust gas.

In the catalyst converter 10 having the exhaust gas receiver 21, the bypass exhaust gas supplied to the catalyst 11 flows in the following manner. The bypass exhaust gas flowing out from the passage outlet Re of the bypass passage R of the turbocharger T flows toward the catalyst end surface 111 at an acute hitting angle θ with respect to the catalyst end surface 111. Since the hitting angle θ is acute, as shown in FIG. 4, the bypass exhaust gas having reached the catalyst end surface 111 hits against and bounce off the catalyst end surface 111, whereby bouncing gas flows (bounce flows) Gb and Gc are generated. The bounce flows Gb and Gc expand in a region around a portion of the catalyst end surface 111 against which the mainstream Ga of the bypass exhaust gas hits.

Since the exhaust gas receiver 21 is provided between the expanded passage portion 132 of the upstream connection member 13 and the catalyst end surface 111, the bounce flows Gb and Gc of the bypass exhaust gas reach the space 211 defined by the exhaust gas receiver 21. Subsequently, the bounce flows Gb and Gc hit against and are received by the exhaust gas receiver 21. Further, the bounce flows Gb and Gc are led toward an inner part of the passage toward which the exhaust gas receiver 21 extends, and are merged into the mainstream Ga of the bypass exhaust gas. In this case, since the inner edge portion 212 of the exhaust gas receiver 21 is directed toward the catalyst end surface 111, the bounce flows Gb and Gc are led toward the catalyst end surface 111 and are merged into the mainstream Ga of the bypass exhaust gas. Therefore, the bounce flows Gb and Gc can be smoothly merged into the mainstream Ga of the bypass exhaust gas.

Of the bounce flows Gb and Gc, the bounce flow Gb flowing toward the side opposite the side toward which the flow path of the bypass exhaust gas is inclined becomes a relatively large flow. Even so, since the exhaust gas receiver 21 has the largest width L and the largest height H in the counter-inclination-side portion 216, the bounce flow Gb flowing toward the opposite side is reliably received by the exhaust gas receiver 21.

Figure 5:
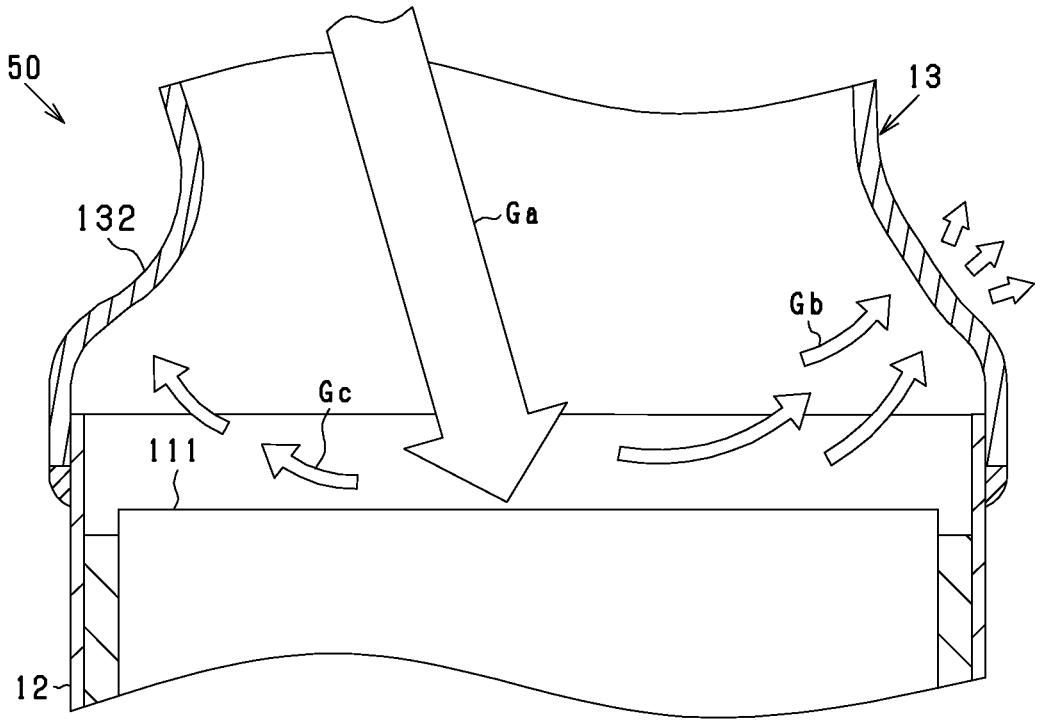
FIG. 5 is an enlarged sectional view for explaining conventional flows of the bypass exhaust gas.

By contrast, as shown in the comparative example of FIG. 5, in a conventional catalytic converter 50 which does not have the exhaust gas receiver 21, the bounce flows Gb and Gc which are produced as a result of the bypass exhaust gas hitting against the catalyst end surface 111 and bouncing off the catalyst end surface 111 hit against the inner surface of the expanded passage portion 132 of the upstream connection member 13. As a result, a heat of the bypass exhaust gas is released outward through the expanded passage portion 132 of the upstream connection member 13. As a result of the release of the heat, the heat is drawn from the bypass exhaust gas, so that the heat cannot be efficiently transmitted to the catalyst 11.

On that point, as shown in FIG. 4, according to the catalyst converter 10 of the present embodiment, since the bounce flows Gb and Gc hit against and are received by the exhaust gas receiver 21, the bounce flows Gb and Gc are restrained from hitting against the expanded passage portion 132 of the upstream connection member 13 in contact with the outside air. Accordingly, there is restrained outward release of the heat of the bypass exhaust gas from the expanded passage portion 132 of the upstream connection member 13. As a result, there is restrained drawing of the heat from the bypass exhaust gas, which could otherwise result from release of the heat from the expanded passage portion 132, so that the heat of the bypass exhaust gas is efficiently transmitted to the catalyst 11.

The catalytic converter 10 of the present embodiment described above in detail can yield the following effects.

(1) The exhaust gas receiver 21 is provided between the expanded passage portion 132 of the upstream connection member 13 and the catalyst end surface 111 in the catalyst converter 10. The exhaust gas receiver 21 extends in such a manner that the exhaust gas receiver 21 separates from the expanded passage portion 132 and the space 211 is defined between the exhaust gas receiver 21 and the catalyst end surface 111. Accordingly, when the bypass exhaust gas flowing out from the passage outlet Re of the bypass passage R of the turbocharger T hits against the catalyst end surface 111 at an acute hitting angle θ, the resultant bounce flows Gb and Gc of the bypass exhaust gas hit against and are received by the exhaust gas receiver 21. Thus, the bounce flows Gb and Gc are restrained from hitting against the expanded passage portion 132; accordingly, there is restrained outward release of the heat of the bypass exhaust gas through the expanded passage portion 132 in contact with the outside air. As a result, the heat of the bypass exhaust gas can be efficiently transmitted to the catalyst 11.

(2) The inner edge portion 212 of the exhaust gas receiver 21 is directed toward the catalyst end surface 111. Accordingly, the bounce flows Gb and Gc of the bypass exhaust gas hitting against and received by the exhaust gas receiver 21 are led toward the catalyst end surface Ill by the exhaust gas receiver 21. As a result, the bounce flows Gb and Gc of the bypass exhaust gas hitting against the exhaust gas receiver 21 can be smoothly merged into the mainstream Ga of the bypass exhaust gas.

(3) In the counter-inclination-side portion 216 where the bounce flows Gb and Gc become relatively large flows, the width L of the exhaust gas receiver 21 is the largest, and the height H of the inner edge portion 212 is the largest, thereby increasing the size of the space 211. Accordingly, the exhaust gas receiver 21 can more reliably receive the large bounce flows Gb and Gc. Also, since the exhaust gas receiver 21 is designed to reduce in the width L and the height H toward the inclination-side portion 215, despite provision of the exhaust gas receiver 21 between the expanded passage portion 132 of the upstream connection member 13 and the catalyst end surface 111, design freedom of the expanded passage portion 132 is less likely to be affected by presence of the exhaust gas receiver 21.

(4) The exhaust gas receiver 21 extends along the entire circumferences of the catalyst accommodation case 12 and the attachment tube portion 22. Accordingly, the exhaust gas receiver 21 receives the bounce flows Gb and Gc of the bypass exhaust gas along the entire circumference. As a result, the bounce flows Gb and Gc are further restrained from hitting against the expanded passage portion 132 of the upstream connection member 13, so that the heat of the bypass exhaust gas can be more efficiently transmitted to the catalyst 11.

(5) The opening 213 defined by the inner edge portion 212 of the exhaust gas receiver 21 has a sufficient size for allowing passage of the mainstream Ga of the bypass exhaust gas flowing out from the passage outlet Re of the bypass passage R and hitting against the catalyst end surface 111. Accordingly, despite provision of the exhaust gas receiver 21 along the entire circumference, the mainstream Ga of the bypass exhaust gas directed to the catalyst end surface 111 is less likely to be disturbed by presence of the exhaust gas receiver 21.

The structure of the catalytic converter 10 is not limited to that of the above embodiment, but may be implemented, for example, as follows.

Figure 6:
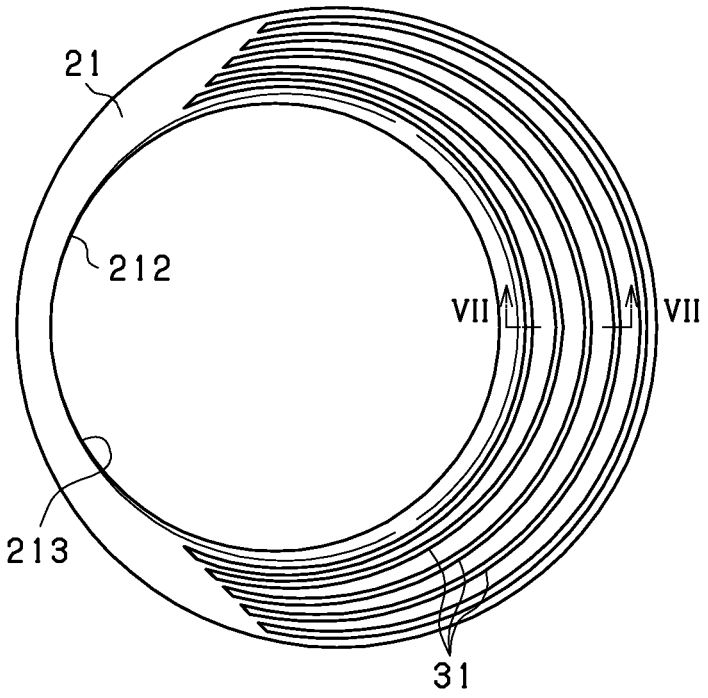
FIG. 6 is a plan view showing another example of the exhaust gas receiver having slits.
Figure 7:
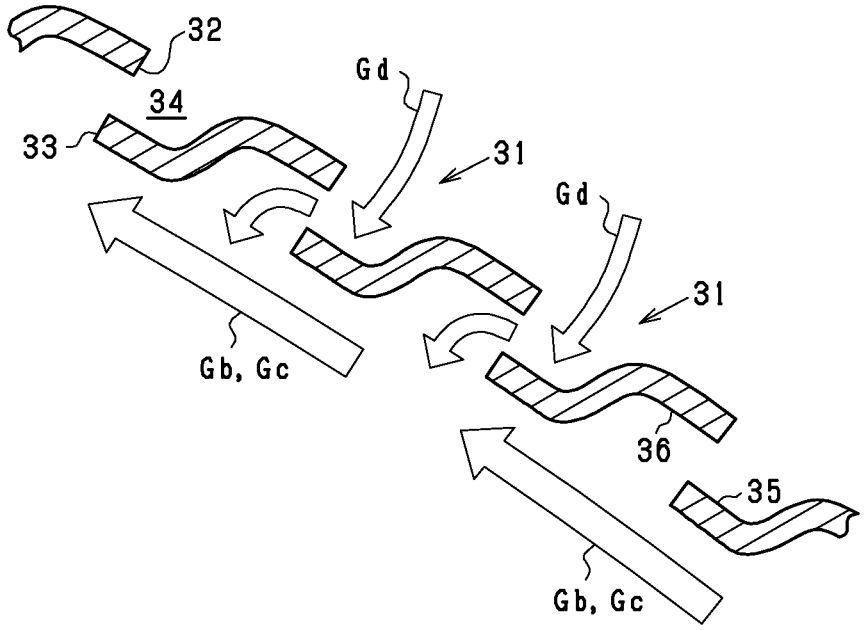
FIG. 7 is a sectional view taken along line VII-VII of FIG. 6.

(a) In the above embodiment, as shown in FIGS. 6 and 7, the exhaust gas receiver 21 may have slits 31 formed therein and extending in the circumferential direction in which the exhaust gas receiver 21 extends. The slits 31 establish communication between the space 211 on the downstream side of the exhaust gas receiver 21 and a space on the upstream side of the exhaust gas receiver 21. The number of the slits 31 juxtaposed in the width direction of the exhaust gas receiver 21 may be more than one as illustrated or one.

As shown in FIG. 7, the exhaust gas receiver 21 is formed from a metal plate such that each slit 31 has an upstream-side slit portion 32, a downstream-side slit portion 33, and a slit passage portion 34. The upstream-side slit portion 32 is provided in an upstream outer surface of the exhaust gas receiver 21, and the downstream-side slit portion 33 is provided in a downstream inner surface of the exhaust gas receiver 21. The upstream-side slit portion 32 and the downstream-side slit portion 33 are offset in position from each other in the width direction of the exhaust gas receiver 21 and communicate with each other through the slit passage portion 34. Since the upstream-side slit portion 32 and the downstream-side slit portion 33 are offset in position from each other, when the upstream-side slit portion 32 is viewed from the upstream side, a first bottom portion 35 is provided on the far side of the upstream-side slit portion 32. Also, when the downstream-side slit portion 33 is viewed from the downstream side, a second bottom portion 36 is provided on the far side of the downstream-side slit portion 33.

Since the slits 31 have such a structure, as shown in FIG. 7, the bypass exhaust gas having reached the exhaust gas receiver 21 from the upstream side passes the exhaust gas receiver 21 through the slits 31 and flows to the downstream side of the exhaust gas receiver 21 as indicated by arrows Gd. Therefore, a flow of the bypass exhaust gas is less likely to be disturbed by presence of the exhaust gas receiver 21. Accordingly, by means of expanding the exhaust gas receiver 21, the heat of the bypass exhaust gas can be more efficiently transmitted to the catalyst 11 through stagnation of the bounce flows Gb and Gc of the bypass exhaust gas inside the exhaust gas receiver 21.

Further, despite formation of the slits 31, since the second bottom portions 36 are provided on the far side of the downstream-side slit portions 33, the bounce flows Gb and Gc of the bypass exhaust gas hitting against and bouncing off the exhaust gas receiver 21 can be restrained from passing through the exhaust gas receiver 21 toward the upstream side. Accordingly, the bounce flows Gb and Gc are led toward an inner part of the passage toward which the exhaust gas receiver 21 extends, and are merged into the mainstream Ga of the bypass exhaust gas. Therefore, similar to the case of the above embodiment, the bounce flows Gb and Gc are restrained from hitting against the expanded passage portion 132, so that the heat of the bypass exhaust gas is efficiently transmitted to the catalyst 11.

The slit 31 extending in the circumferential direction may have the form of a large number of fine slits 31 disposed in the circumferential direction instead of extending continuously in the circumferential direction.

(b) In the above embodiment, the inner edge portion 212 of the exhaust gas receiver 21 is directed toward the catalyst end surface 111. Instead, the inner edge portion 212 may extend in parallel with the catalyst end surface 111 or may extend, without bending, toward the upstream side of the catalyst 11 in an inclined manner. Even in such a case, the exhaust gas receiver 21 extending toward an inner part of the passage can receive the bounce flows Gb and Gc of the bypass exhaust gas and restrain the bounce flows Gb and Gc from hitting against the expanded passage portion 132. Also, since the exhaust gas receiver 21 extends obliquely upstream, the exhaust gas receiver 21 can lead the bounce flows Gb and Gc in such a manner that the bounce flows Gb and Gc are merged into the mainstream Ga.

Figure 8:
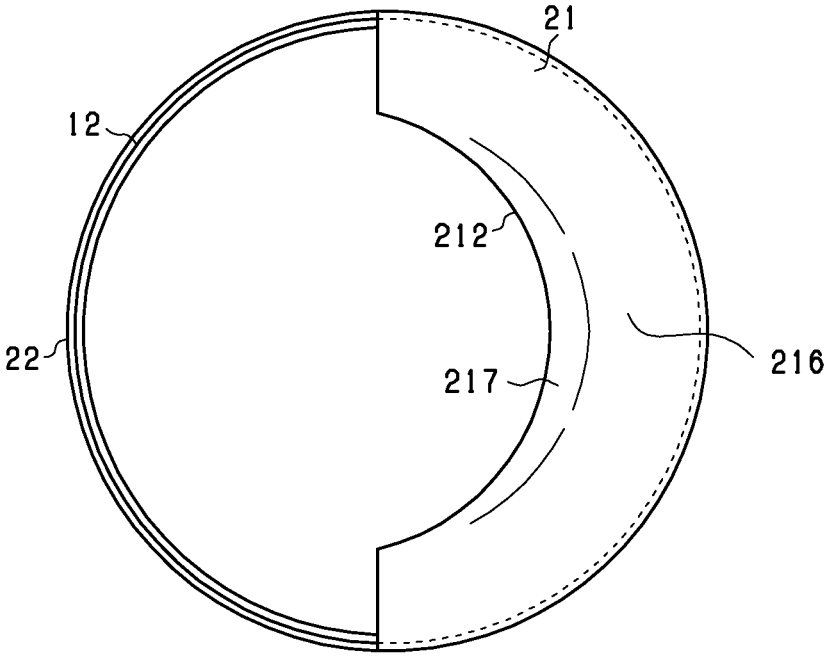
FIG. 8 is a plan view showing a further example of the exhaust gas receiver.

(c) In the above embodiment, the inner edge portion 212 of the exhaust gas receiver 21 is directed toward the catalyst end surface 111 over the entire circumference of the inner edge portion 212. Instead, as shown in FIG. 8, the inner edge portion 212 may be directed toward the catalyst end surface 111 only within a predetermined range encompassing the counter-inclination-side portion 216, so as to form an inclined end portion 217.

Figure 9:
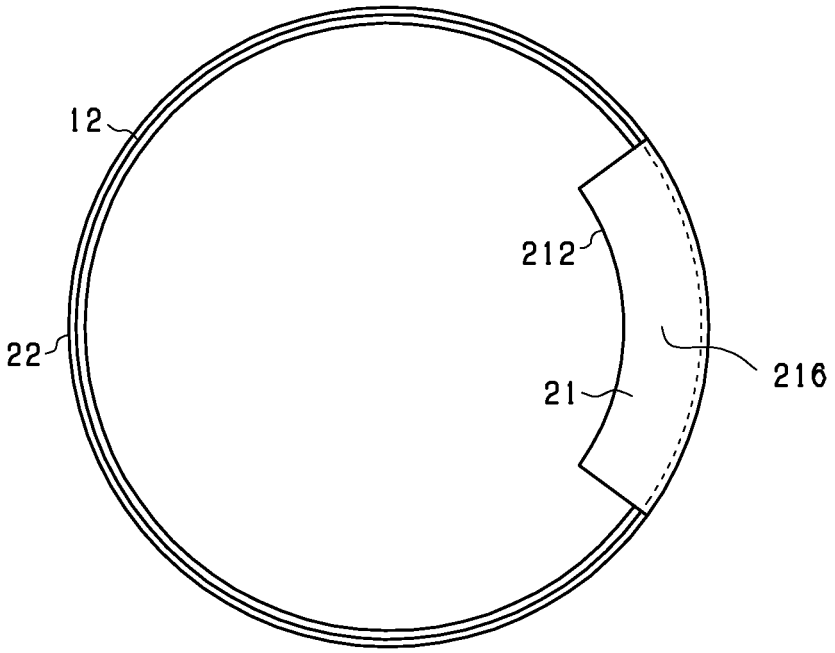
FIG. 9 is a plan view showing still another example of the exhaust gas receiver.

(d) In the above embodiment, the exhaust gas receiver 21 extends along the entire circumference of the upstream end of the attachment tube portion 22. Instead, the exhaust gas receiver 21 may extend only within a predetermined range. For example, as shown in FIG. 8, the exhaust gas receiver 21 may extend only along a semicircle of the attachment tube portion 22 in such a manner as to extend from the counter-inclination-side portion 216 by 90 degrees each in opposite directions. Alternatively, as shown in FIG. 9, the exhaust gas receiver 21 may extend from the counter-inclination-side portion 216 in opposite directions within a range less than 180 degrees. Even in the case of limiting the range of extension of the exhaust gas receiver 21, since the bounce flows Gb and Gc of the bypass exhaust gas are the largest in the counter-inclination-side portion 216, the range must encompass the counter-inclination-side portion 216.

In the above embodiment, the inner edge portion 212 of the exhaust gas receiver 21 is such that the height H above the catalyst end surface 111 reduces from the counter-inclination-side portion 216 toward the inclination-side portion 215 along the circumference of the exhaust gas receiver 21. Instead, the height H of the inner edge portion 212 may be uniform.

Further, in the above embodiment, the width L of the exhaust gas receiver 21 in a planar view as viewed in a direction perpendicular to the catalyst end surface 111 is the largest in the counter-inclination-side portion 216 and gradually reduces along the circumference of the exhaust gas receiver 21. Instead, for example, as shown in FIG. 9, the width L of the exhaust gas receiver 21 may be uniform.

Meanwhile, the range of extension of the exhaust gas receiver 21, the height H of the inner edge portion 212, and the width L of the exhaust gas receiver 21 are determined in consideration of various factors such as the hitting angle θ of the bypass exhaust gas, the inflow amount of the bypass exhaust gas, the position on the catalyst end surface 111 where the mainstream Ga of the bypass exhaust gas hits against the catalyst end surface 111, and whether a portion concerned is the counter-inclination-side portion 216 or a portion located away from the counter-inclination-side portion 216. These factors are based on the displacement of an automobile and restrictions on disposition of the catalytic converter 10 within an engine room.

For example, as the hitting angle θ of the bypass exhaust gas reduces, the bounce flows Gb and Gc of the bypass exhaust gas hitting against the catalyst end surface 111 tend to become large. Accordingly, when the hitting angle θ is small, preferably, the range of extension of the exhaust gas receiver 21 is increased, the height H of the inner edge portion 212 is increased, and/or the width L of the exhaust gas receiver 21 is increased. By contrast, as the hitting angle θ of the bypass exhaust gas increases, the bounce flows Gb and Gc of the bypass exhaust gas hitting against the catalyst end surface 111 tend to become small. Accordingly, when the hitting angle θ is large, the range of extension of the exhaust gas receiver 21 may be reduced, the height H of the inner edge portion 212 may be reduced, and/or the width L of the exhaust gas receiver 21 may be reduced.

(e) In the above embodiment, the attachment tube portion 22 of the exhaust gas receiver 21 intervenes between the catalyst accommodation case 12 and the expanded passage portion 132 of the upstream connection member 13. Instead, the following structure may be employed: the downstream connection end portion 135 of the expanded passage portion 132 is fitted to the outer circumference of the upstream opening end portion 121 of the catalyst accommodation case 12, and the attachment tube portion 22 is fitted to the inner circumference of the upstream opening end portion 121. Also, in contrast to the above embodiment in which the expanded passage portion 132 is disposed externally of the upstream opening end portion 121 of the catalyst accommodation case 12, the expanded passage portion 132 may be disposed internally of the upstream opening end portion 121. In this case, the attachment tube portion 22 of the exhaust gas receiver 21 may be disposed between the catalyst accommodation case 12 and the expanded passage portion 132 of the upstream connection member 13 or may be disposed internally of the downstream connection end portion 135 of the expanded passage portion 132. Meanwhile, the structure of the above embodiment is preferred, because the attachment tube portion 22 of the exhaust gas receiver 21 and the downstream connection end portion 135 of the expanded passage portion 132 can be welded at a time on the outer side of the upstream opening end portion 121 of the catalyst accommodation case 121.

(f) In the above embodiment, in a plan view as viewed in a direction perpendicular to the catalyst end surface 111, the opening 213 defined by the inner edge portion 212 of the exhaust gas receiver 21 has a circular shape. Instead, the opening 213 may have a polygonal shape such as a rectangular shape, or an elliptic shape.

(g) The above embodiment is described while referring to the catalytic converter 10 for use in an automobile. Instead, the present disclosure may be applied to a catalytic converter for use in an internal combustion engine of other than an automobile, such as a motorcycle, a ship, and an aircraft.

The present disclosure has been described in conformity with examples but is not limited to the examples and the structures therein. Further, the present disclosure encompasses a variety of variation examples and variations in the scope of equivalents of the present disclosure. In addition, a variety of combinations and forms and even other combinations and forms to which only one element or two or more elements are added fall within the scope and ideological range of the present disclosure.

What is claimed is:

1. An exhaust arrangement, containing a catalytic converter and a turbocharger; comprising:

a catalyst accommodation case configured to accommodate a catalyst; and an upstream connection member having an upstream passage portion of which a passage area is smaller than an area of an end surface of the catalyst and which leads an exhaust gas flowing out from the turbocharger to the catalyst, and an expanded passage portion located downstream of the upstream passage portion and connected to an upstream opening end portion of the catalyst accommodation case to expand from the upstream passage portion; wherein the turbocharger includes a bypass passage out from which a bypass exhaust gas flows; and;

the catalyst end surface is provided at a position that a bypass exhaust gas flowing out from a passage outlet of the bypass passage flows along a flow path inclined toward one side with respect to a line perpendicular to the catalyst end surface and hits against the catalyst end surface; and the exhaust arrangement further comprises an exhaust gas receiver provided between the expanded passage portion and the catalyst end surface at least in a counter-inclination-side portion opposite the side toward which the flow path is inclined, and configured to receive a flow of the bypass exhaust gas bouncing off the catalyst end surface; and the exhaust gas receiver extends from the upstream opening end portion of the catalyst accommodation case toward an inner part of the expanded passage portion, being separated from the expanded passage portion and a space is defined between the exhaust gas receiver and the catalyst end surface.

2. The exhaust arrangement according to claim 1, wherein an inner edge portion of the exhaust gas receiver is directed toward the catalyst end surface.

3. The exhaust arrangement according to claim 1, wherein the exhaust gas receiver is provided along the upstream opening end portion of the catalyst accommodation case to extend in a circumferential direction, and an inner edge portion of the exhaust gas receiver reduces in height above the catalyst end surface circumferentially from the counter-inclination-side portion toward the side toward which the flow path is inclined.

4. The exhaust arrangement according to claim 1, wherein a width of the exhaust gas receiver in a plan view as viewed in a direction perpendicular to the catalyst end surface gradually reduces along a circumference of the upstream opening end portion of the catalyst accommodation case.

5. The exhaust arrangement according to claim 1, wherein the exhaust gas receiver extends along the entire circumference of the catalyst accommodation case.

6. The exhaust arrangement according to claim 5, wherein an opening defined by an inner edge portion of the exhaust gas receiver is sized to allow passage of a mainstream of the bypass exhaust gas flowing out from the passage outlet of the bypass passage and hitting against the catalyst end surface.

7. The exhaust arrangement according to claim 1, wherein the exhaust gas receiver has a slit which establishes communication between a space on the upstream side of the exhaust gas receiver and a space on the downstream side of the exhaust gas receiver; and the slit has an upstream-side slit portion provided on the upstream side of the exhaust gas receiver, a downstream-side slit portion provided on the downstream side of the exhaust gas receiver at a position offset from the upstream-side slit portion, and a slit passage portion establishing communication between the upstream-side slit portion and the downstream-side slit portion and allowing the bypass exhaust gas flowing in from the upstream-side slit portion to flow toward the downstream-side slit portion.

* * * * *